US010427285B2

(12) United States Patent
Echasserieau

(10) Patent No.: US 10,427,285 B2
(45) Date of Patent: Oct. 1, 2019

(54) PUNCHING TOOL EQUIPPED WITH A GUIDE SLEEVE

(71) Applicant: Airbus Operations SAS, Toulouse (FR)

(72) Inventor: Gilles Echasserieau, Cordemais (FR)

(73) Assignee: AIRBUS OPERATIONS SAS, Toulouse (FR)

( * ) Notice: Subject to any disclaimer, the term of this patent is extended or adjusted under 35 U.S.C. 154(b) by 115 days.

(21) Appl. No.: 15/677,156

(22) Filed: Aug. 15, 2017

(65) Prior Publication Data

US 2018/0056494 A1 Mar. 1, 2018

(30) Foreign Application Priority Data

Aug. 25, 2016 (FR) ..... 16 57925

(51) Int. Cl.

| | |
|---|---|
| ***B25D 5/02*** | (2006.01) |
| ***B21J 15/50*** | (2006.01) |
| ***B25B 27/04*** | (2006.01) |
| ***B25D 5/00*** | (2006.01) |

(52) U.S. Cl.

CPC ..... *B25D 5/02* (2013.01); *B21J 15/50* (2013.01); *B25B 27/04* (2013.01); *B25D 5/00* (2013.01); *B25D 2250/231* (2013.01); *B25D 2250/371* (2013.01)

(58) Field of Classification Search

CPC ..... B25D 5/02; B25D 5/00; B25D 2250/231; B25D 2250/371; B21J 15/20; B25B 27/04

See application file for complete search history.

(56) References Cited

U.S. PATENT DOCUMENTS

| | | | | |
|---|---|---|---|---|
| 1,225,191 A * | 5/1917 | Throckmorton | ..... | B25D 5/02 33/674 |
| 2,328,391 A * | 8/1943 | Nelson | ..... | B21J 15/36 72/466.5 |
| 2,430,532 A * | 11/1947 | Rayburn | ..... | B22C 21/14 227/142 |
| 2,641,379 A | 6/1953 | Joseph | | |
| 2,981,006 A | 4/1961 | Keklikian | | |
| 3,172,204 A | 3/1965 | Frey | | |

(Continued)

FOREIGN PATENT DOCUMENTS

| | | |
|---|---|---|
| FR | 892745 | 5/1944 |
| FR | 964389 | 8/1950 |

(Continued)

OTHER PUBLICATIONS

French Search Report, dated May 4, 2017, priority document.

*Primary Examiner* — Omar Flores Sanchez

(74) *Attorney, Agent, or Firm* — Greer, Burns & Crain, Ltd.

(57) ABSTRACT

A punching tool which comprises a body, a rod oriented in a first direction and comprising a free end configured to cooperate with the element to be punched, a guide sleeve containing a conduit extending from a first end face to a second end face and configured to rest against the part. The conduit comprises a first portion which opens at the first end face and is configured to house the body of the punching tool and to allow a translation movement of the body of the punching tool relative to the guide sleeve.

9 Claims, 1 Drawing Sheet

(56) References Cited

U.S. PATENT DOCUMENTS

| | | | | |
|---|---|---|---|---|
| 4,070,755 | A * | 1/1978 | Carter | H01R 43/22<br>173/120 |
| 4,649,733 | A * | 3/1987 | Gilmore | B21J 15/36<br>29/243.53 |
| 2002/0148120 | A1 | 10/2002 | Welch | |
| 2007/0107237 | A1 * | 5/2007 | Long | B25D 5/00<br>30/360 |
| 2012/0180287 | A1 | 7/2012 | Rudgley | |

FOREIGN PATENT DOCUMENTS

| | | |
|---|---|---|
| FR | 2651166 | 3/1991 |
| GB | 2463346 | 3/2010 |

* cited by examiner

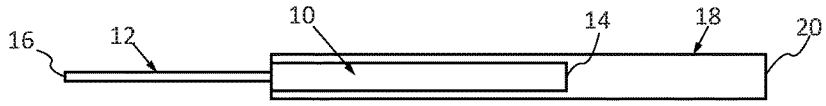
Fig. 1
Prior Art
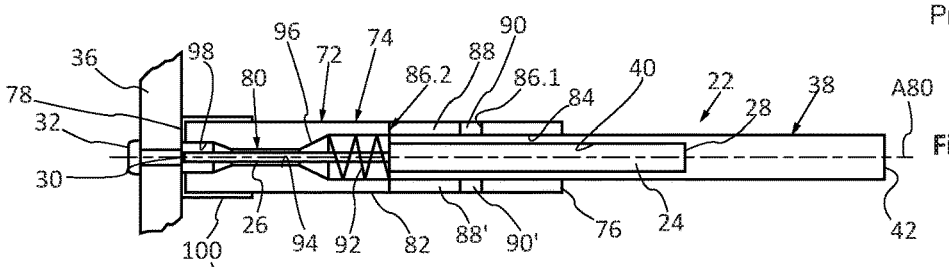
Fig. 2A
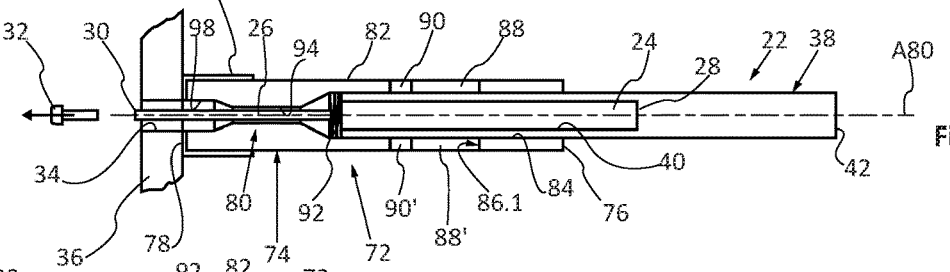
Fig. 2B
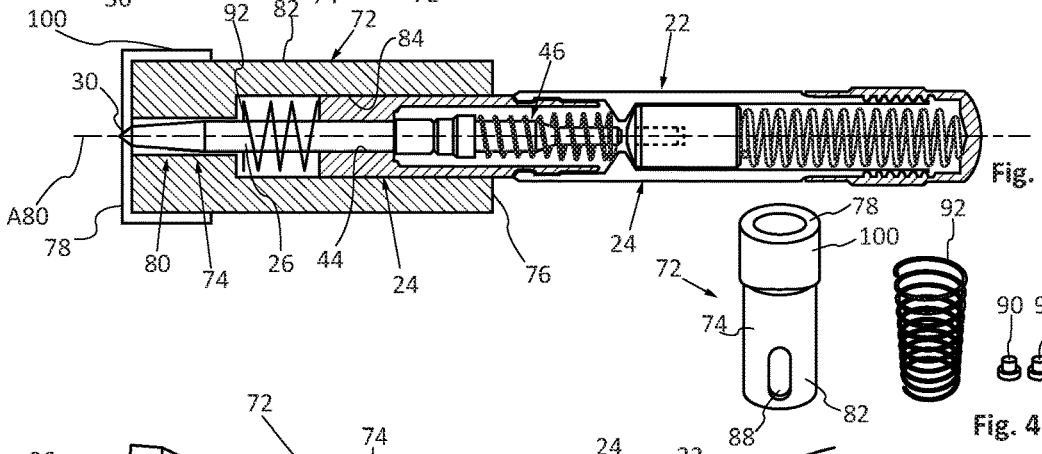
Fig. 3
Fig. 4
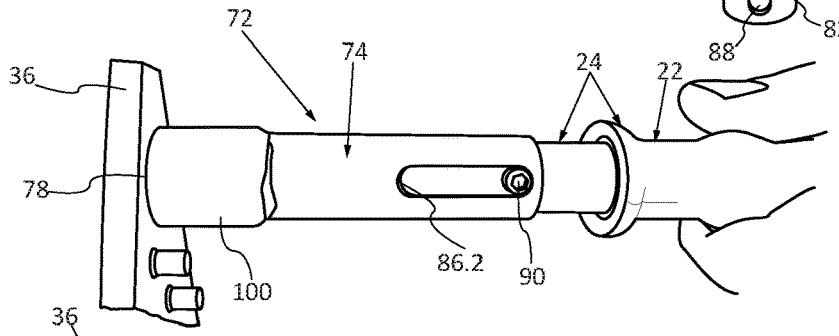
Fig. 5A
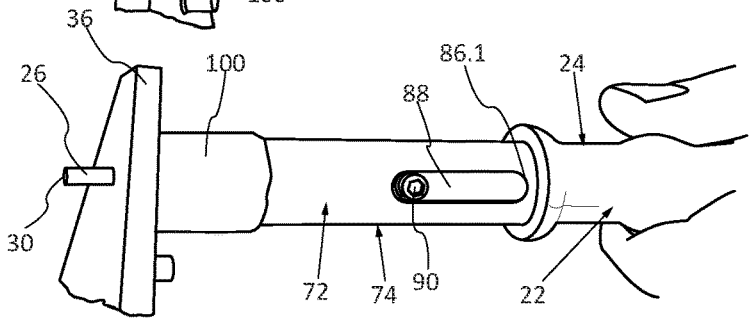
Fig. 5B

PUNCHING TOOL EQUIPPED WITH A GUIDE SLEEVE

CROSS-REFERENCES TO RELATED APPLICATIONS

This application claims the benefit of the French patent application No. 1657925 filed on Aug. 25, 2016, the entire disclosures of which are incorporated herein by way of reference.

BACKGROUND OF THE INVENTION

The present application relates to a punching tool equipped with a guide sleeve.

For the present application, a punching tool is a tool such as a drift punch or center punch for example, used to extract a fixing such as a rivet or a screw, for example, which has been inserted in a hole of a part with a clamped fixing.

According to a first known arrangement shown in FIG. 1, a punching tool comprises a body 10 extended by a rectilinear rod 12. The body 10 comprises a punching face 14 opposite the rod 12, and the rod 12 comprises a free end 16 configured to rest against a fixing to be extracted. The body 10 of the punching tool may be inserted in a first end of a jet 18 as illustrated in FIG. 1.

According to this first known arrangement, a large clear space is necessary around the fixing for receiving the hammer blows directly on the punching face 14 or on the second end 20 of the jet 18.

According to a second known arrangement, a so-called automatic punching tool comprises:

a body, a rod movable relative to the body and comprising a free end configured to rest against the fixing to be extracted, and a striking system positioned inside the body and configured to strike the movable rod.

The striking system comprises a striker, a governor weight, a first compression spring which presses the striker towards the rod, and a second compression spring which presses the governor weight in the direction of the striker. The striker comprises a rear end oriented towards the weight. The weight comprises a housing configured to house the rear end of the striker.

Whatever the embodiment, only the free end of the rod rests against the fixing to be extracted at the time when the impact is applied either by the hammer or by the striking system. Consequently, there are risks of damaging the part if the free end of the rod slips off the fixing to be extracted.

SUMMARY OF THE INVENTION

The present invention aims to remedy the drawbacks of the prior art.

To this end, the invention concerns a punching tool for extracting an element to be punched from a hole in a part, the punching tool comprising a body and a rod oriented in a first direction and comprising a free end configured to cooperate with the element to be punched.

According to the invention, the punching tool comprises a guide sleeve which contains a guide with a conduit extending from a first end face to a second end face and configured for resting against the part, the conduit comprising a first portion which opens at the first end face and is configured for housing the body of the punching tool and allowing a translation movement of the body of the punching tool relative to the guide in the first direction between a rest position, in which the rod of the punching tool is positioned inside the conduit of the guide sleeve, and an active position, in which the rod of the punching tool protrudes relative to the second end face of the guide sleeve.

This configuration limits the risks of damage to the part since the second end face of the guide sleeve is in contact with the part.

According to another characteristic, the guide sleeve comprises two stops for limiting the translation movement of the body of the punching tool, a first stop configured to immobilize the body of the punching tool in the rest position, and a second stop configured to immobilize the body of the punching tool in the active position.

According to another characteristic, the punching tool comprises a compression spring configured to push the body of the punching tool into the rest position.

According to another characteristic, the second end face is flat and arranged in a plane perpendicular to the first direction.

According to another characteristic, the second end face of the guide sleeve comprises forms which cooperate with the element to be punched in order to immobilize the guide sleeve. Preferably, the conduit comprises a second portion which opens at the second end face and is configured for housing a part of the punching tool. According to one embodiment, this second portion has a cross-section substantially equal to a cross-section of the punching tool.

According to another characteristic, the second end face of the guide comprises a coating which reinforces the adhesion between the guide and the part.

According to another characteristic, the guide comprises a protection of a material which limits the risks of damage to the part. According to one embodiment, the protection is a coating which covers at least a second end face.

BRIEF DESCRIPTION OF THE DRAWINGS

Further characteristics and advantages will arise from the description below of the invention, which is given merely as an example and with reference to the attached drawings on which:

FIG. 1 is a cross-section of a punching tool according to a first embodiment of the prior art, FIGS. 2A and 2B are cross-sections of a punching tool equipped with a guide sleeve, illustrating a first embodiment of the invention in a rest position and an active position respectively, FIG. 3 is a cross-section of an automatic punching tool equipped with a guide sleeve, illustrating a second embodiment of the invention, FIG. 4 is a perspective view of various elements of a guide sleeve, illustrating an embodiment of the invention, FIGS. 5A and 5B are perspective views of a punching tool equipped with a guide sleeve, illustrating the second embodiment of the invention in a rest position and an active position respectively.

DETAILED DESCRIPTION OF THE PREFERRED EMBODIMENTS

According to a first embodiment shown in FIGS. 2A and 2B, a punching tool 26 comprises an elongate body 24 and a rectilinear rod 26 integral with the body 24 and positioned at a first end of the body 24. The rod 26 and the body 24 are aligned and oriented in a first direction. The body 24 comprises, at a second end opposite the rod 26, a punching face 28 arranged in a plane perpendicular to the first direction.

The rod 26 comprises a free end 30 configured to cooperate with an element to be punched 32 in order to extract the element from a hole 34 of a part 36 with a clamped fixing.

As an example, the element to be punched 32 may be a screw or a rivet.

According to a first variant, the free end 30 comprises a flat face perpendicular to the first direction. In this case, the punching tool is known as a drift punch.

According to a second variant, the free end 30 is pointed. In this case, the punching tool is known as a center punch.

According to this first embodiment, the punching tool 26 comprises a jet 38 which, at a first end, comprises a housing 40 configured for receiving the body 24 at least partially, and, at a second end, a punching face 42 arranged in a plane substantially perpendicular to the first direction.

As a variant, the punching tool 22 may not comprise the jet 38.

According to a second embodiment shown in FIGS. 3, 5A and 5B, a so-called automatic punching tool 22 comprises:

a hollow body 24 with an opening 44 at a first end, a rod 26 movable relative to the hollow body 24 and passing through the opening 44, a striking system 46 positioned inside the hollow body 24 and configured to strike the rod 26.

Whatever the embodiment, the punching tool 22 comprises a body 24 and a rectilinear rod 26 which has a free end 30 configured to cooperate with an element to be punched 32. The rod 26 and the body 24 are aligned and oriented in a first direction.

According to a characteristic of the invention, the punching tool 22 comprises a guide sleeve 72 which has a guide 74. This guide 74 extends from a first end face 76 to a second end face 78 and comprises a conduit 80 which extends from the first end face 76 to the second end face 78. This conduit 80 comprises an axis A80 oriented in a second direction.

According to one embodiment, the guide 74 comprises an approximately cylindrical lateral surface 82 coaxial to the axis A80 and connecting the first and second end faces 76 and 78.

The second end face 78 is configured to rest against the part 36. Preferably, the second end face 78 is flat and arranged in a plane perpendicular to the second direction.

The conduit 80 comprises a first portion 84 which opens at the first end face 76 and is configured for housing the body 24 of the punching tool 22, or the jet 38 of the punching tool 22, and for allowing a translation movement of the body 24 of the punching tool 22 in the second direction. The conduit 80 has a diameter greater than that of the rod 26 of the punching tool 22.

According to one embodiment, the body 24 or the jet 38 has an outer cylindrical wall, the first portion 84 of the conduit 80 has a diameter equal to a sliding clearance for the diameter of the outer cylindrical wall.

According to the invention, after assembly of the guide sleeve 72 and the punching tool 22, the first and second directions are congruent and the punching tool 22 is configured to move relative to the guide sleeve 72 between a rest position shown in FIGS. 2A and 5A, in which the rod 26 of the punching tool 22 is positioned inside the conduit 80 of the guide sleeve 72 and does not protrude relative to the second end face 78, and an active position shown in FIGS. 2B and 5B, in which the rod 26 of the punching tool 22, and, more particularly, its free end 30, protrude relative to the second end face 78 of the guide sleeve 72.

According to another characteristic of the invention, the travel of the body 24 of the punching tool 22 relative to the guide sleeve 72 is determined such that the free end 30 of the rod 26 is positioned in the plane of the second end face 78 or slightly offset towards the inside of the conduit 80 in the rest position, and the distance between the free end 30 of the rod 26 and the second end face 78 is sufficient, in the active position, to extract an element to be punched 32.

According to another characteristic, the guide sleeve 72 comprises at least one stop for limiting the translation movement of the body 24 of the punching tool 22 in the second direction. Preferably, the guide sleeve 72 comprises two stops 86.1, 86.2, a first stop 86.1 configured to immobilize the body 24 of the punching tool 22 in the rest position, and a second stop 86.2 configured to immobilize the body 24 of the punching tool 22 in the active position.

According to one embodiment, the guide 74 comprises at least one slot 88 which opens on one side in the lateral surface 82 and on the other side in the first portion 84 of the conduit 80. This slot 88 is an oblong slot with the long axis oriented in the second direction, the length of the oblong slot being determined such that the first end of the oblong slot forms the first stop 86.1 which corresponds to the rest position, and the second end of the oblong slot forms the second stop 86.2 which corresponds to the active position.

According to one configuration, the guide 74 comprises two diametrically opposed slots 88, 88'.

For each slot 88, 88', the guide sleeve 72 comprises a screw 90, 90' configured to be screwed into a thread provided in the body 24 of the punching tool 22, each screw 90, 90' being positioned to come to rest against the first end of the oblong slot 88, 88' in the rest position and to come to rest against the second end of the oblong slot 88, 88' in the active position.

According to another characteristic, the guide sleeve 78 comprises a return means, such as, for example, a compression spring 92, configured to hold the body 24 of the punching tool 22 in the rest position.

According to an embodiment shown in FIGS. 2A and 2B, the conduit 80 comprises a central portion 94 with a reduced diameter, which is less than that of the first portion 84, to ensure guidance of the rod 26 of the punching tool, the central portion 94 and the first portion 84 being linked by a conical or flat base 96 arranged in a transverse plane (perpendicular to the second direction). According to this embodiment, the compression spring 92 is positioned around the rod 26 of the punching tool 22 and is interposed between the base 96 and the body 24 of the punching tool 22.

According to another characteristic of the invention, the second end face 78 of the guide sleeve 72 comprises forms which cooperate with the element to be punched 32 in order to immobilize the guide sleeve 72 relative to the part 36.

Preferably, the conduit 80 comprises a second portion 98 which opens at the second end face 78 and is configured for housing a part of the element to be punched 32. This second portion 98 has a cross-section greater than that of the rod 26 of the punching tool 22. Once the guide sleeve 72 and the punching tool 22 are assembled, the rod 26 of the punching tool 22 is centered relative to the second portion 98 of the conduit 80 of the guide sleeve 72.

In general, the rod 26 has a diameter substantially equal to that of the element to be punched 32.

When the element to be punched 32 comprises a crimping ring, the second portion 98 has a diameter greater than that of the element to be punched 32, substantially equal to that of the crimping ring.

When the element to be punched 32 has a cylindrical part protruding relative to the part 36, the second portion 98 of the conduit 80 has a cylindrical form with a diameter identical to that of the protruding cylindrical part of the element to be punched 32.

Thus the second portion 98 allows the guide sleeve 72 to be positioned correctly relative to the element to be punched 32. Since the rod 26 of the punching tool 22 is centered relative to the second portion 98 of the conduit 80 of the guide sleeve 72, the rod 26 of the punching tool 22 is correctly positioned relative to the element to be punched 32.

According to one embodiment, the second end face 78 of the guide 74 comprises a coating which reinforces the adhesion between the guide 74 and the part 36.

According to another characteristic, the guide 74 comprises a protection 100 of a material which limits the risk of damage of the part 36.

Advantageously, this protection 100 also limits the risks of the guide sleeve 72 slipping off the part 36.

For example, the material of the protection 100 is a rubber, a plastic material or similar According to a first variant, the guide 74 is made of a material limiting the risks of damage to the part 36.

According to a second variant, the protection 100 is a coating which covers at least the second end face 78. According to one embodiment, the coating is a thermoplastic adhesive sheath configured for receiving the second end face 78 and at least part of the lateral surface 82 of the guide 74 adjacent to the second end face 78.

The advantages obtained by the invention are as follows:

the guide sleeve 72 allows limitation of the risk of damage of the part 36 due to the protection 100, the guide sleeve 72 allows limitation of the risks of slippage and sliding due to the protection 100 which reinforces the adhesion between the guide sleeve 72 and the part, and/or due to the forms of the second end face 78 which cooperate with the element to be punched 32;

the guide sleeve 72 also allows a better positioning of the rod 26 of the punching tool 22 relative to the element to be punched 32, due to the forms of the second end face 78 which cooperate with the element to be punched 32;

the guide sleeve 72 also allows orientation of the rod 26 of the punching tool 22 relative to the part 36, due to the second end face 78 which is perpendicular to the rod 26 of the punching tool 22 and is configured to be pressed against the part 36;

the guide sleeve 72 may be fitted to existing punching tools 22 by production of holes for the screws 90, 90';

the guide sleeve 72 may be fitted equally well to punching tools of the non-automatic type, as illustrated in FIGS. 2A and 2B, and those of the automatic type, as illustrated in FIGS. 3, 5A and 5B.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A punching tool for extracting an element to be punched from a hole of a part, the punching tool comprising:

a body and a rod oriented in a first direction and comprising a free end configured to cooperate with an element to be punched, a guide sleeve containing a guide with a conduit extending from a first end face to a second end face and configured to rest against the part, said conduit comprising a first portion which opens at the first end face and is configured to house the body of the punching tool and allow a translation movement of the body of the punching tool relative to the guide in the first direction between a rest position, in which the rod of the punching tool is positioned inside the conduit of the guide sleeve, and an active position, in which the rod of the punching tool protrudes relative to the second end face of the guide sleeve, said conduit comprises a second portion having a diameter greater than a diameter of the first portion wherein the second portion opens at the second end face and is configured to house a part of the element to be punched.

2. The punching tool as claimed in claim 1, wherein the guide sleeve comprises two stops for limiting the translation movement of the body of the punching tool, a first stop configured to immobilize the body of the punching tool in the rest position, and a second stop configured to immobilize the body of the punching tool in the active position.

3. The punching tool as claimed in claim 1, further comprising a compression spring configured to push the body of the punching tool into the rest position.

4. The punching tool as claimed in claim 1, wherein the second end face is flat and is arranged in a plane perpendicular to the first direction.

5. The punching tool as claimed in claim 1, wherein the second end face of the guide sleeve comprises forms which cooperate with the element to be punched in order to immobilize the guide sleeve.

6. The punching tool as claimed in claim 5, wherein the conduit comprises the second portion is configured to house a part of the punching tool.

7. The punching tool as claimed in claim 1, wherein the second end face of the guide comprises a coating which reinforces the adhesion between the guide and the part.

8. The punching tool as claimed in claim 1, wherein the guide comprises a protection made of a material which limits the risks of damage to the part.

9. The punching tool as claimed in claim 8, wherein the protection is a coating which covers at least a second end face.

* * * * *